United States Patent [19]

Schiele et al.

[11] Patent Number: 4,998,458

[45] Date of Patent: Mar. 12, 1991

[54] DEVICE FOR LOADING AN ARMORED WEAPON

[75] Inventors: August Schiele; Gert Kausträter, both of Augsburg, Fed. Rep. of Germany

[73] Assignee: Kuka Wehrtechnik GmbH, Augsburg, Fed. Rep. of Germany

[21] Appl. No.: 41,123

[22] Filed: Apr. 10, 1987

[30] Foreign Application Priority Data

Apr. 11, 1986 [DE] Fed. Rep. of Germany ..... 3612208

[51] Int. Cl.[5] ..... F41A 9/20

[52] U.S. Cl. ..... 89/46; 89/47

[58] Field of Search ..... 89/36.13, 45, 46, 47

[56] References Cited

U.S. PATENT DOCUMENTS 470,285 3/1892 Canet ..... 89/46

1,105,813 8/1914 Meigs et al. ..... 89/46

FOREIGN PATENT DOCUMENTS 362603 8/1938 Italy ..... 89/46

*Primary Examiner*—Stephen C. Bentley

*Attorney, Agent, or Firm*—Antonelli, Terry, Stout & Kraus

[57] ABSTRACT

An installation for the mechanized loading of an armored weapon with large caliber cartridges consists of a conveyor device leading from the bottom of the loading area into the turret in the rear of the breech of the weapon with a conveyor container for holding the cartridge and a continuous belt driven by a motor, a guide device which has roller sets arranged in the area of each end of the transport container and two guide tracks, each assigned to one roller set, which lead the transport container with the inserted cartridge from an approximately vertical position on the bottom of the loading area to a horizontal position, level with the weapon, in front of the breech, and a rammer, accelerating the cartridge with open weapon breech into the weapon chamber.

18 Claims, 6 Drawing Sheets

DEVICE FOR LOADING AN ARMORED WEAPON

Figure 1:
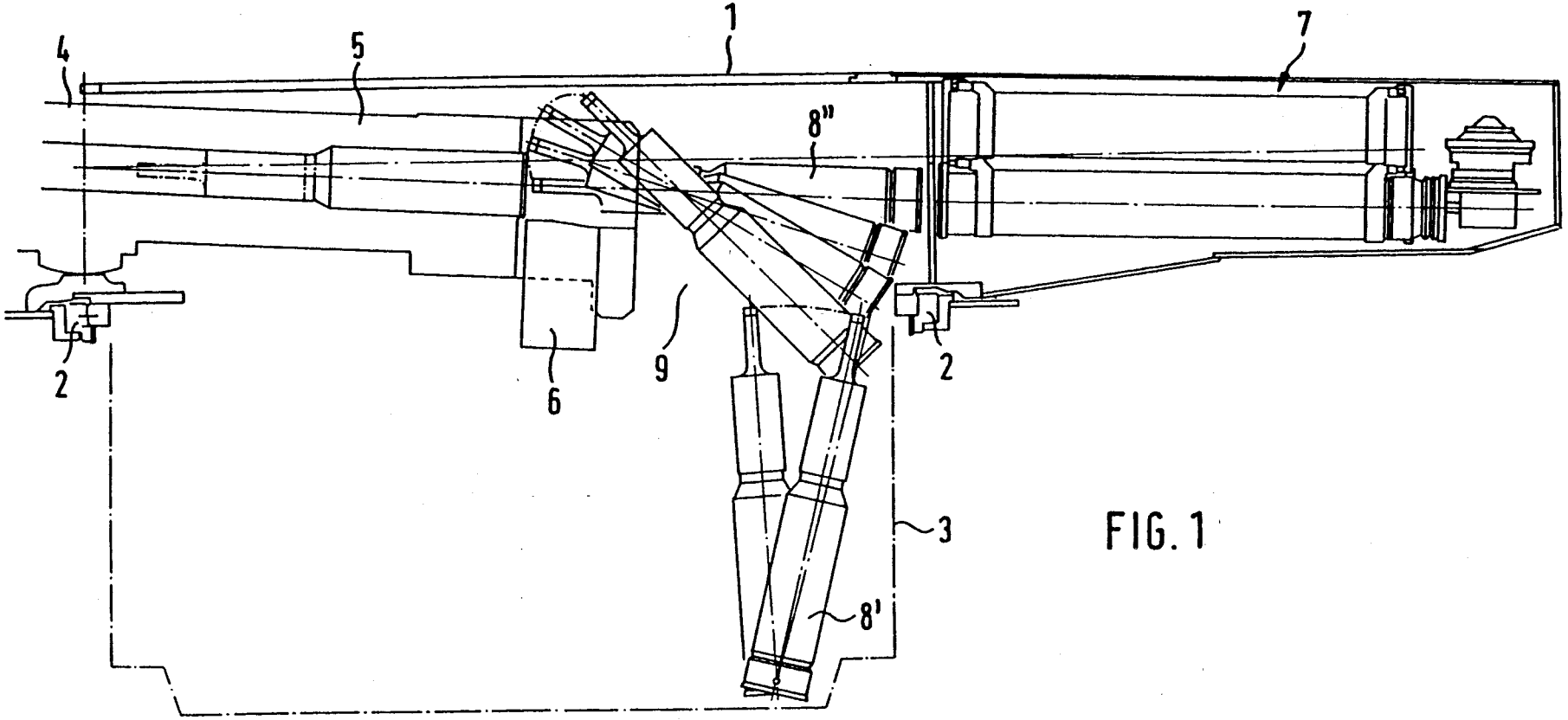

The invention concerns a device for the loading an armored weapon with large caliber cartridges, which a e kept ready on the floor of the loading area of the tank.

For the loading of armored weapons, particularly those with large caliber, automatically working loading devices are already known which primarily result from the demand for higher firing speed, but also ease the manual labor of the loading gunner. They generally consist of a type of magazine for a large number of cartridges which is arranged at the height of the weapons chamber at a distance from it and rotates essentially in a horizontal plane, whereby the individual magazine chambers can be brought into a position which is in alignment with the weapons chamber and the weapon. The distance between the weapons chamber or the breech arranged in front of it and the loading device is bridged by a loading bridge, which is arranged in a pivotable manner in order to also make manual loading from below possible.

These automatic loading devices are costly to construct, complicated in their operation and thus expensive. They require either a concept of a turret adapted to this, e.g., in the shape of a flat turret projecting towards the rear or—in case of later installation in existing turrets—considerable changes on the turret construction. For the rest, magazine with its limited capacity also requires a more frequent refilling.

The invention is based on the problem to create a loading device with a simple construction which simply mechanizes the individual loading process and, without alterations, can be later installed into any tank turret.

This problem is solved, according to the invention, by (a) a conveyor device leading from the bottom of the loading area into the turret at the rear of the breech of the weapon, consisting of a transport container for holding the cartridge and a continuous drive, driven by a motor, (b) a conveyor device, consisting of a set of guide rollers, arranged on each end of the transport container and two guide tracks, one each assigned to each set of rollers, which bring the transport container with the inserted cartridge from an approximately vertical position at the foot of the conveyor device to a horizontal position, aligned with the weapon at the rear of the breech of the weapon and (c) a rammer which, with open breech, speeds the cartridge into the weapons chamber from the transport container.

The complete loading device can be installed in the empty space of the turret or the tank basket underneath the weapons chamber which is already designed for the loading gunner. The loading gunner will no longer have to pick up the cartridge from the floor of the loading area, lift it to the height of the weapons chamber and insert it, but only has to grasp the cartridge and insert it into the transport container which is in its lower starting position, from which it is then transported upwards to the front of the weapons chamber by means of a continuous drive. It is possible to just grab the cartridge at its tip with one hand and to set it approximately vertically into the transport container. The conveyor device first makes sure that the cartridge gets from this approximately vertical position into the horizontal position in front of the weapons chamber. As the length of the cartridge may, under certain circumstances—particularly with large calibers—be greater than the space between the weapons chamber or the breech, on the one hand, and, the rear wall of the turret or turret storage area, on the other hand, the conveyor device is constructed in such a manner that the cartridge with the tip in front is tilted forward with increasing tilt, but that the tilting into the horizontal position only takes place towards the end of the conveyor movement when the tip is already above the breech. When the transport container and thus the cartridge have attained their final horizontal position, at which time the breech is in its opened position, the cartridge is sped from the transport conveyor into the weapons chamber by the rammer. After the closing of the breech, the weapon is ready for firing. Before that, the empty transport container is moved back by the conveyor device to its lower starting position and is ready for another loading operation.

According to a preferred embodiment it is planned that the conveyor device has a continuous chain as continuous drive which is driven at the bottom of the conveyor device by an electric motor and to which the transport container is attached by its rear end through a pivot bearing.

This provides for a constructively simple and functionally secure drive for the transport container. The transport container is only attached to the continuous chain by its lower end, thus is pulled during the loading process, while its track curve is determined by it shape and arrangement of the two guide tracks on which the two roller sets, mounted at the upper and lower end of the transport container are running.

In another advantageous embodiment it is planned that the guide track for the roller set is rigidly arranged at the rear end of the transport container and the guide track for the roller set at the front end of the transport container is mounted at the foot of the conveyor device in such a manner that during the loading process its upper end can be pivoted from a position pointing away to a position in front of the breech of the weapon and during the return of the empty transport container it can again be pivoted into the turned away position.

The rigid guide track leads the transport conveyor by its lower or rear end, while the pivotable guide track guides the upper or front end. Due to the pivotability of this guide track it is attained that, on the one hand, during the loading process the transport container is supported in its horizontal position as close as possible to the weapon and a faultless transfer to the weapons chamber is possible, and, on the other hand, immediately after the loading process and pivoting backwards of the guide track there is sufficient space for the unhindered weapons return after the firing of the weapon.

In another embodiment, in which the rigidly arranged guide track and the pivotably mounted guide track are slightly tilted towards the rear, while the latter is about vertical in its position near the breech, it is attained that the transport container is not vertical but slightly tilted towards the rear so that the loading gunner can tip the cartridge into the transport container, which is ergonomically more advantageous than the exactly vertical position. It is also suitable that the pivotable guide track runs at its upper end in a fixed guide which reaches above the pivoting angle.

A favorable embodiment is also one where a pivoting drive is assigned to the pivotable guide track, which provides it with a synchronous movement with that of the transport container, i.e., the pivoting motion of the front guide track takes forcibly place with the motion during the loading process, or the return of the empty transport container. It can be provided for that the pivoting drive consists of a continuous chain and a crank driven by the chain wheel.

A constructively and functionally particularly simple embodiment is obtained when the continuous chains of the conveyor device and of the pivotable guide track are driven by the same electric motor which is arranged at the foot of the conveyor device, so that only a single drive motor is needed for the total loading device.

Finally, it is suitable that the crank for chain wheel moving the pivotable guide track is mounted on the rigid guide track so that a compact self-contained construction unit is created which can be installed into existing tank towers during refitting.

The transport container of the conveyor device should generally be made in such a way that even large caliber cartridges can be inserted by the loading gunner with a minimum of effort. In a preferred embodiment it is planned that the transport container is essentially made in a cylindrical shape and consists of a rigid half-bowl and quarter-bowls tilted against it which can be flipped open for the insertion of the cartridge and can be pivoted into a locking position and locked after insertion.

In the opened position, i.e., with flipped open quarter-bowls, the cartridge can be set into the transport container from the side without it having to be substantially lifted from its readiness position or having to be moved by hand for any distance in the lifted position. After the insertion of the cartridge, the quarter-bowls are flipped inward around their hinges, so that they complete the half-bowl to a closed cylindrical container in which the cartridge is safely housed and from which it is faultlessly led on the first part of the acceleration path after reaching the horizontal end position and triggering of the rammer.

Between the rigid half-bowl and each quarter-bowl at least one tension spring overlapping the hinge between them is preferably installed, which holds the quarter-bowls in the open position and against the effect of which the quarter-bowls can be flipped into the locked position after the insertion of the cartridge. The quarter-bowls are held in the flipped open position by means of the springs overlapping the hinges. The design is such that the quarter-bowls automatically flip into the closed position when the cartridge is inserted, because, e.g., the quarter-bowls each have a section with the same bending radius reaching into the area of the half-bowl against which the cartridge to be set onto the floor of the transport container and to be tilted against the half-bowl hits and thus flips the quarter-bowl into the locked position during the tilting motion.

According to another embodiment, the lock of the quarter-bowls can be released by means of a stop arranged in the area of the foot of the conveyor device, so that the transport container opens automatically at the end of the return when the lower stop is reached by the flipping open of the quarter-bowls because of the spring action, and a new cartridge can be inserted.

In another preferred embodiment of the invention it is provided that the rammer is mounted on the transport container and has a bolt which is under the influence of a prestressed spring acting on the bottom of the cartridge, which can be triggered when the transport container reaches the horizontal end position.

This embodiment includes the advantage that the ramming of the cartridge to the weapon occurs by means of a device integrated into the loading device, so that the loading device forms an autonomously closed construction unit which functionally includes all manual actions of the loading gunner.

An advantageous embodiment is distinguished by the fact that the rammer has a sleeve to guide the bolt, arranged in parallel to the axis along the outside of the rigid half-bowl of the transport container, in which a spring is housed and that a stop holding the bolt in the prestressed position is tilted against the sleeve. Due to its arrangement parallel to the axis, the rammer has a minimum space requirement on the transport container.

If, according to another embodiment, the stop cooperates with a fixed trigger, against which the stop hits when reaching the horizontal end position of the transport container and thus releases the bolt, it becomes clear that only a minimum of alterations or added work is needed on the turret itself, which is mainly limited to the creation of the necessary supports and holders for the loading device and the attachment of the trigger for the rammer.

In an advantageous further development the spring of the rammer is stressed during upward motion of the transport container by means of a spring catch which reaches into its path of motion and retains the bolt to a certain length of way until the stop holding the bolt catches. This, on the one hand, automatically brings the rammer into its readiness position by the motion of the transport container, and, on the other hand, this does only take place during the upward motion, thus, the loading process, which provides for a functional and operationally safe design.

In order to assure, with the least possible acceleration force, that the cartridge safely reaches the weapons chamber from the horizontal end position, a guide bowl is tiltably mounted on the top side of the breech, which joins its lower apex and guides the cartridge through the breech into the weapons chamber during its acceleration by the rammer. This takes into account in particular that the cartridge has the tendency, on leaving the transport container, to tilt forward, which might cause it to get stuck on the top of the opened breech.

The loading device according to the invention or its functions are obviously integrated into the functions of the weapon in such a manner that an untimely loading or a repeat loading without first firing of the weapon is not possible. For this purpose there are various possibilities for mutual blocks which the expert can chose in dependence on the respective conditions and requirements.

Other details and advantages of the invention can be seen from the following description of the embodiments shown in the drawings.

Figure 2:
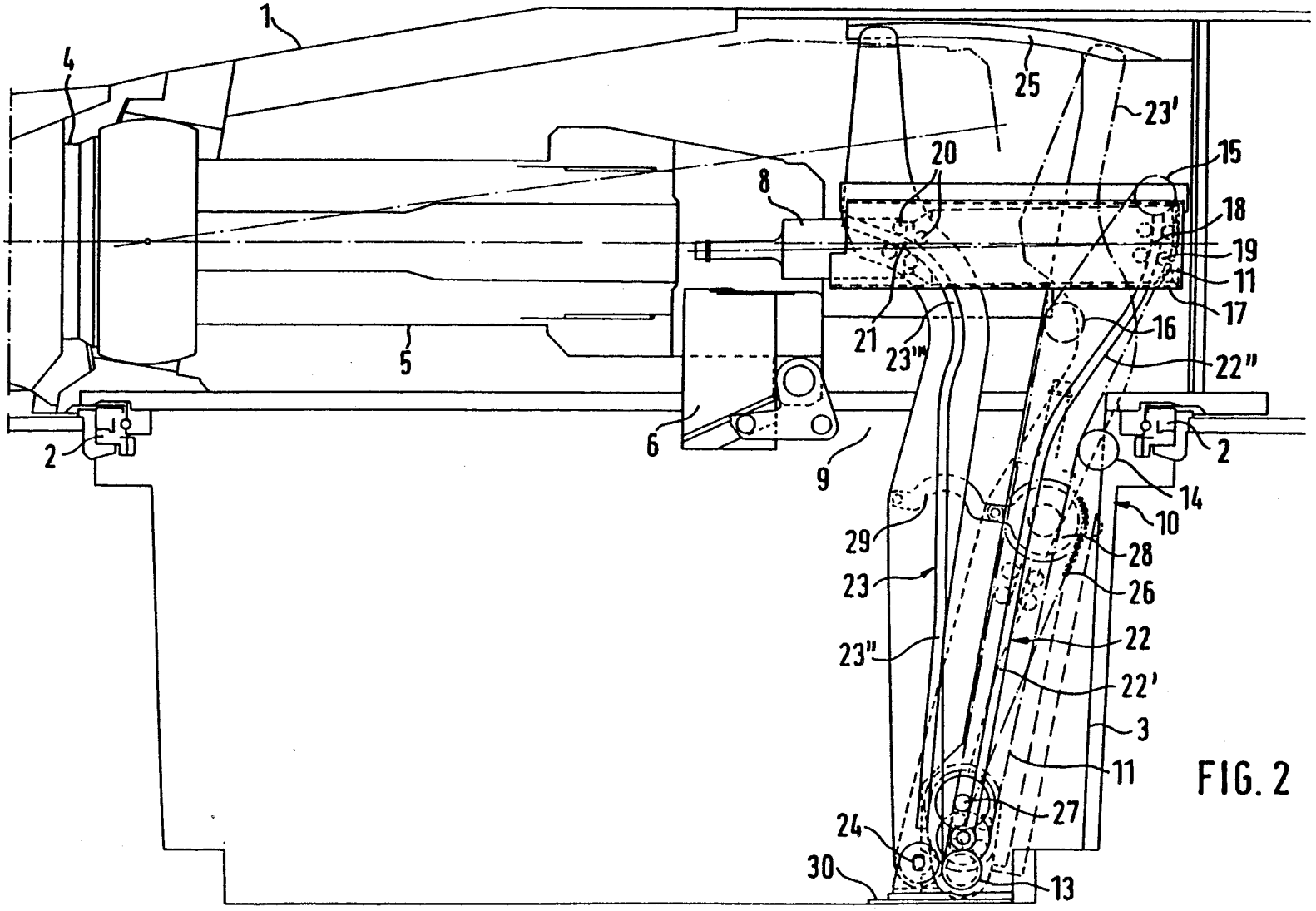
Figure 3:
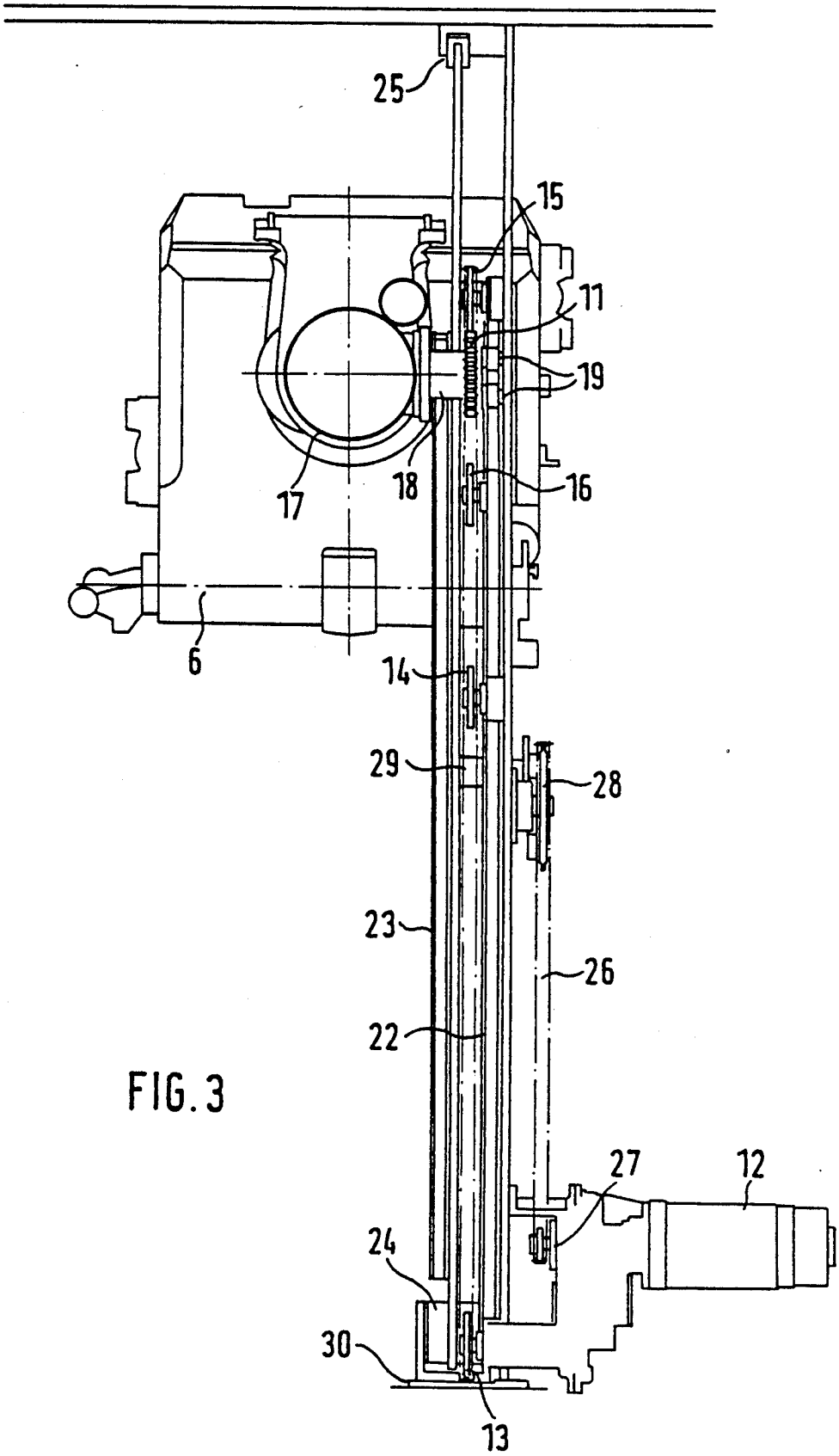
Figure 4:
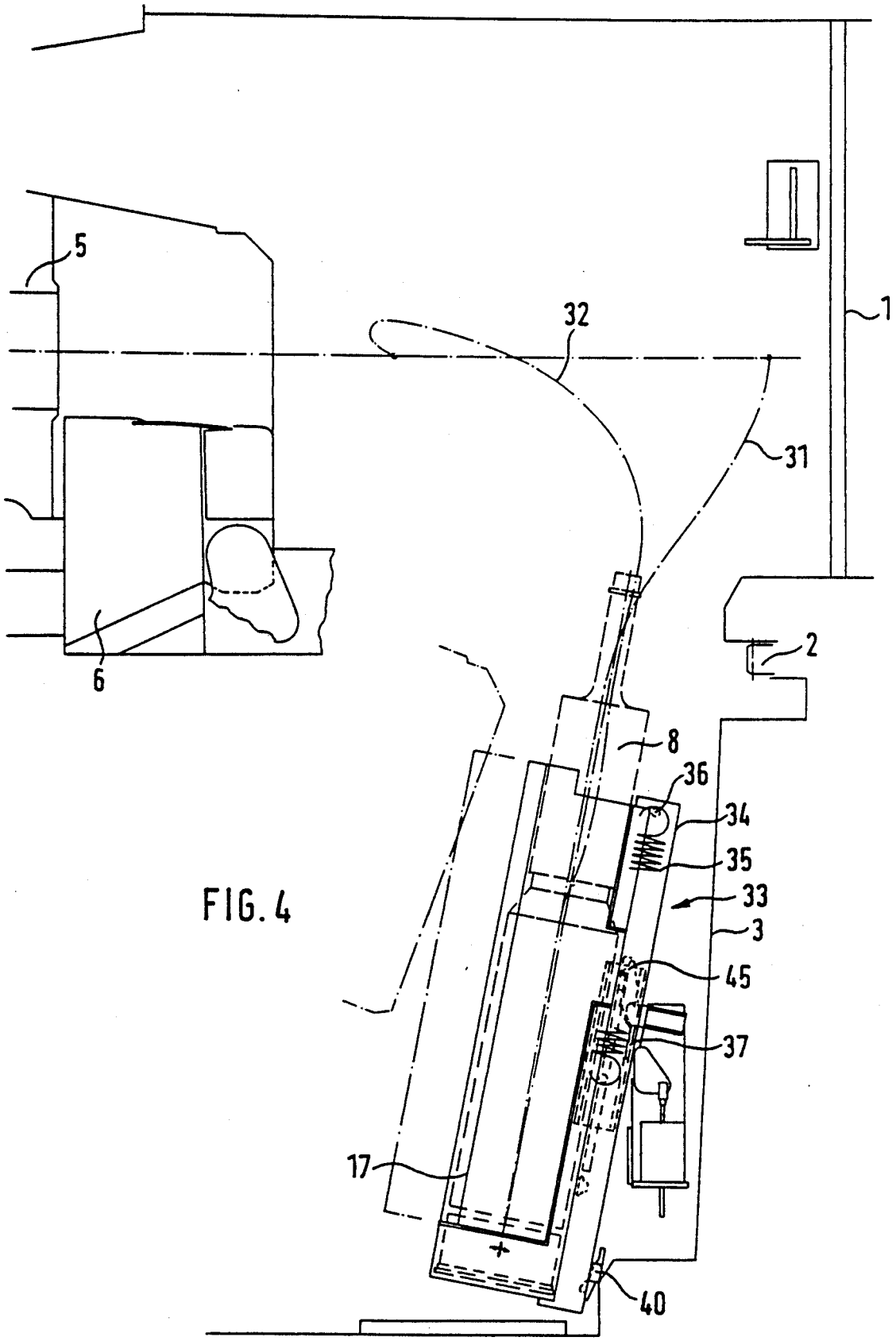
Figure 5:
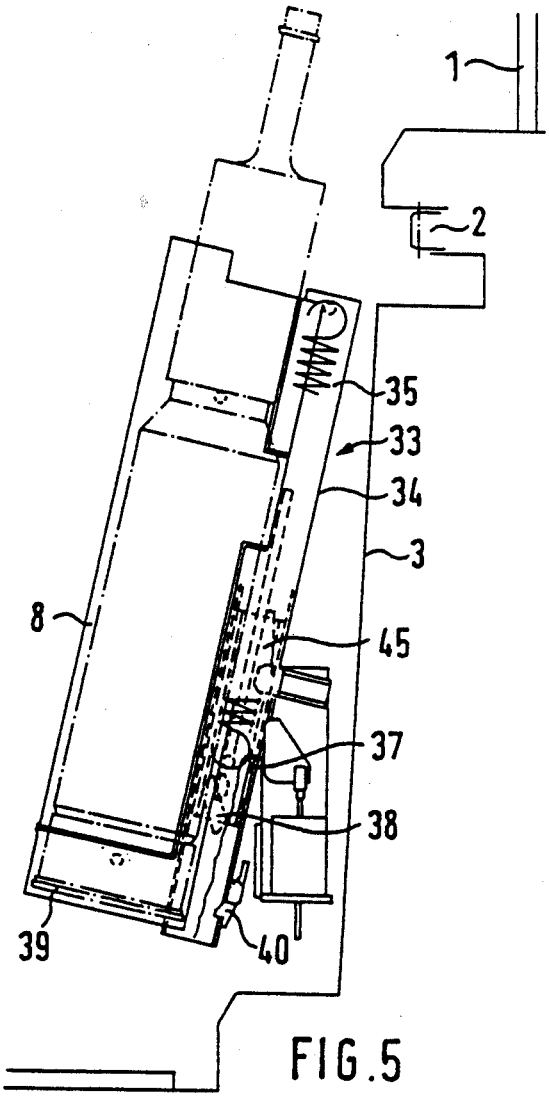
Figure 6:
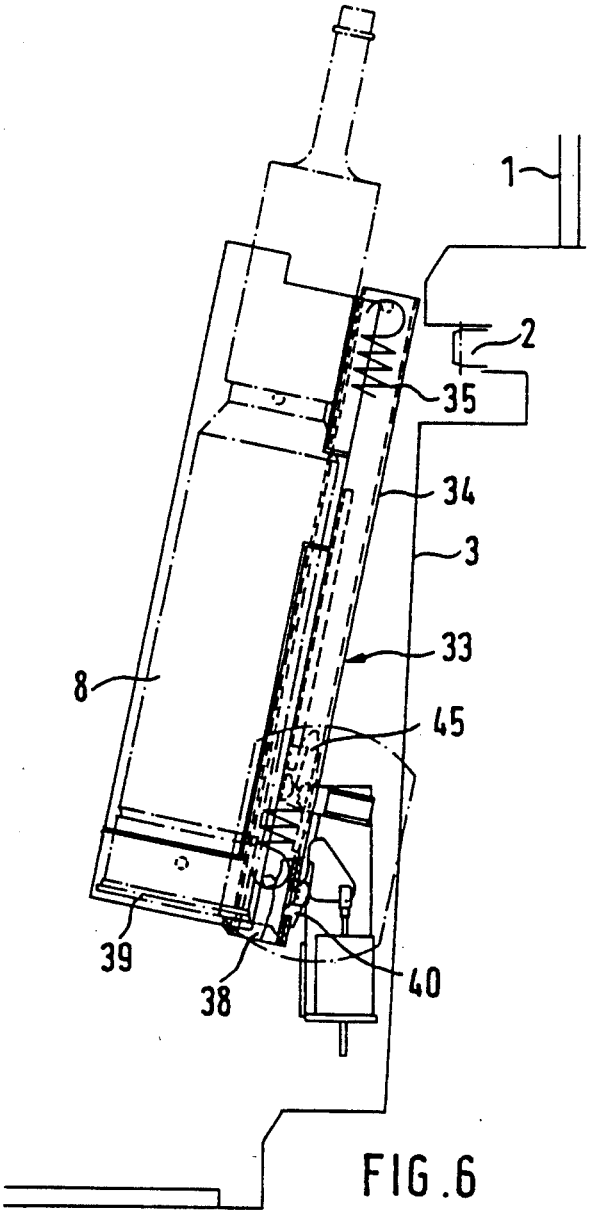
Figure 7:
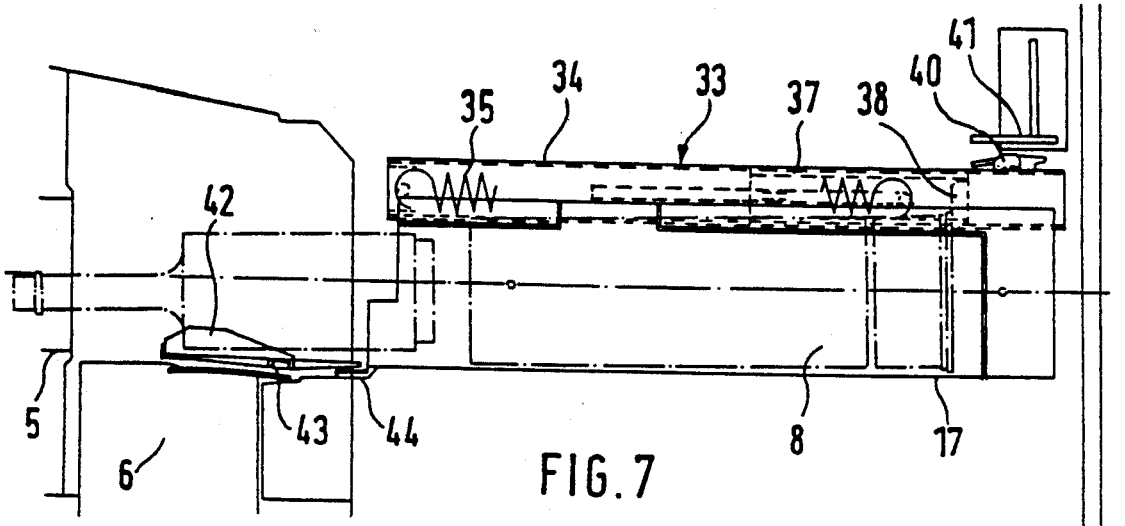
Figure 8:
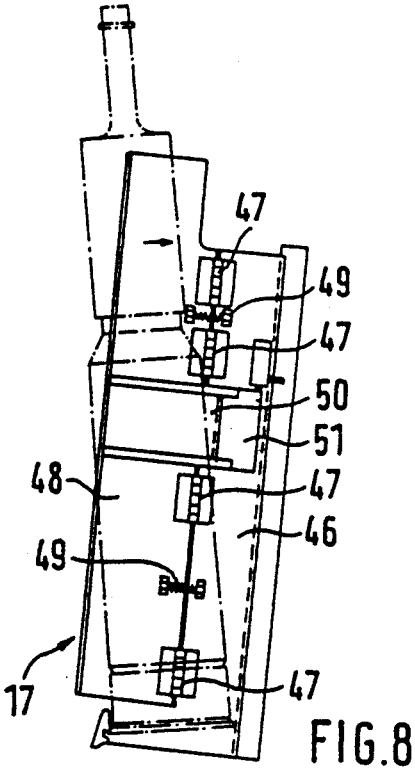
Figure 10:
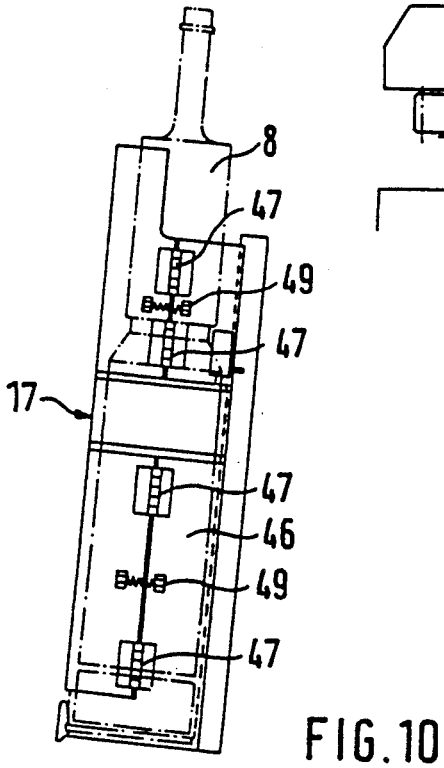
Figure 9:
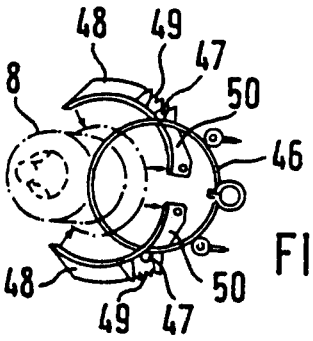
Figure 11:
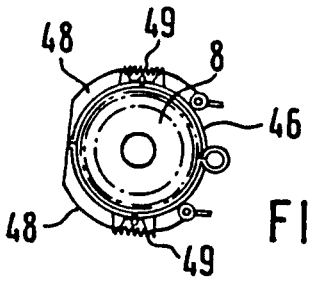

Show in the drawings are:

FIG. 1 a schematic view of a tank turret with a motion analysis motion of the cartridge during the loading process;

FIG. 2 a schematic view, similar to FIG. 1, of another embodiment of a tank turret with an embodiment of the loading device in lateral view;

FIG. 3 a rear view of the representation according to FIG. 2;

FIG. 4 a similar view to FIG. 2 with representation of the path of motion of the cartridge in its starting position;

FIG. 5, 6 and 7 various positions of the cartridge and the conveyor container during the loading process;

FIG. 8 a lateral view of the transport container during the insertion of the cartridge;

FIG. 9 a tow view of the representation according to FIG. 8;

FIG. 10 a lateral view of the closed transport container with inserted cartridge and FIG. 11 a top view of the representation according to FIG. 10.

In FIG. 1, a design of a tank turret 1 is shown as a flat turret, but the invention can be applied to any type of tank turret. Turret 1 sits over a turning bearing 2 on the tank basket 3. In the turret 1 the weapon 4 is arranged, the weapons chamber of which is designated by 5. At the rear of the weapons depot 5 is the schematically indicated breech block 6, shown in its opened position in FIG. 1.

In the embodiment shown in FIG. 1, an automatic loader 7 is housed in the rear area of the flat turret 1 which—as it does not belong to the invention—is not described in more detail here. The inclusion of the automatic loader is only to show that the loading device according to the invention can also be used, if needed, in connection with this type of automatic loaders.

FIG. 1 shows a cartridge 8 in various positions during the loading process with the loading device according to the invention. The cartridges which are located in readiness position in the tank basket 3 or in that area have to be lifted and rotated from position 8' in order to be inserted into the weapons depot 5. The course of motion is schematically indicated in FIG. 1, whereby it can be seen in particular that the free area 9 between the rear of the breech block 6 and the rear part of the pivot bearing 2 is generally more narrow than the length of the cartridge, so that it has to pass through this open area in an upright or more or less tilted position and can only be lifted into the horizontal position 8" towards the end of this motion. The loading device mechanizing this motion is shown in more details in FIGS. 2 ff.

The loading device first has a conveyor device 10, which is formed, in the embodiment shown, by a continuous chain 11. The continuous chain 11 is driven, as shown in FIG. 2, by an electric motor 12, arranged at the bottom of the tank basket 3. There it runs around a chain wheel 13 and is led into the turret 1 and back across several chain wheels 14, 15 and 16 in a track curve.

The conveyor device also has a transport container 17 which holds one cartridge 8 and is shown in FIG. 2 in the upper horizontal final position, immediately before the loading of the weapon. This transport container is hooked to the chain 11 by means of a pivot bearing 18 and a not shown guide strap in the area of its rear end.

The transport container 17 also has, in the area of its rear end, a roller set 19 and in the area of its front end a roller set 20, whereby the rear roller set 19 is mounted on the pivot bearing 18, while the front roller set 20 sits on a rotating joint 21. By means of these roller sets 19, 20, the transport container 17 is led, in each case, on a rear guide track 22 and a front guide track 23. In the shown embodiment the rear guide track 22 is fixed, while the front guide track 23 is turnably mounted at its foot 24 and is led on a fixed track 25 in the area of its upper end. The guide track 23 thus can be turned from the front position in front of the breech 6 of the weapon, shown in FIG. 2 in a solid line, in which it supports the transport container 17 near the weapon through the roller set 20, into the position 23', shown in a broken line, in order to create sufficient space for the return of the weapon after the loading process.

The turning motion of the front guide track 23 is forcibly done by means of another chain drive which is formed by a chain 26 that is also driven by motor 12. Chain 26 is led over a motor chain wheel 27 and a fixed chain wheel 28, which, in the shown embodiment, is pivotably mounted on the rigid rear guide track 22. On the chain wheel 28, a type of crank 29 is mounted which acts on the front guide track 23. Chain 26 runs synchronized with chain 11 of the conveyor device 10 and only is reduced to a different speed.

The course of motion of the cartridge 8 or the transparent container 17 holding it during the loading process, as shown in FIG. 1, is realized, on the one hand, by the shape of the front and rear guide track 22, 23, as shown in FIG. 2, as well as by the pivoting motion of the front guide track 23 during the up and down motion of the transport container. For this purpose, the rigid rear guide track 22 consists of a linear section 22', which extends near the narrow site between weapon breech block 6 and the rear pivot bearing 2, and an adjoining section 22", bent into a somewhat S shape. The pivotable front guide track 23 also consists of a linear section 23", which also reaches into the area of the narrow site 9 and an adjoining section 23"', which is bent somewhat circularly first toward the back and then towards the front.

The full conveyor device 10 with drive chain 11 and the transport container 17 and the guide tracks 22, 23, the chain drive 26 for the guide track 23 and the drive motor 12 for both chain drives sits on a joint base plate 30, by means of which the complete loading device can be inserted into the tank basket 3.

In FIGS. 4 to 7, the course of motion of the transport container 17 with the inserted cartridge 8 is shown in steps. FIG. 4 shows in a dash-dot line 31 the course of motion of the rear end of the transport container 17, while the other dash-dot line 32 indicates the course of motion of the front end of the transport container 17. On these tracks the transport container 17 moves from the slightly backward tilted starting position shown in FIG. 4 into the loading position shown in FIG. 7. In order to accelerate the cartridge 8 from the end position shown in FIG. 7, with open breech block 6, into the weapons chamber, a rammer 33 is arranged on the outside of the transport container 17, which is described in more details based on FIGS. 4 to 7.

On the outside of the transport container 17 an approximately cylindrical sleeve 34 is arranged in which a tension spring in the form of a pull spring is housed. The spring 35 is fixedly hooked with one end 36 into the sleeve, while its other end acts on a bolt 37 led in the sleeve 34. On the lower end of bolt 37 a rammer finger 38 (FIG. 5) is pivotably mounted. In its tenses position the bolt 37 is in the lowest position shown in FIG. 6, in which the rammer finger 38 acts on the bottom 39 of the cartridge. In this position the bolt 37 is fixed against the sleeve 34 by means of a locking catch 40 and the spring 35 kept under tension. For this purpose, the locking catch reaches through two matching windows in the sleeve 34 and the bolt 37.

In this position, shown in FIG. 6, the transport container also attains the loading position according to FIG. 7. In this loading position the locking catch 40 hits against a fixed trigger 41 so that the finger 37 is released and the rammer finger 39 under the effect of the released spring 35 accelerates the cartridge 8 over the breech into the weapons chamber 5. In order to assure a perfect transfer into the weapons depot, a guide is pivotably mounted at 43 on the breech block 6, which is tilted backwards by means of a nose 44 on the transport container 17 during its motion into the horizontal position, so that it tightly adjoins the lower apex of the transport container 17 and guides the cartridge 8 through the breech.

During the downward motion of the empty conveyor container 17, the rammer 33 is in a relaxed position. The tightening of the rammer 33 is automatic during the upward motion of the transport container 17. For this purpose there is a fixed, but pivotably mounted tightening catch 45, which hooks into the bolt 37 during the upwards motion and holds back the bolt as compared to the sleeve 34, moved along with the transport container 17, which has the effect that the spring is tensed until finally the catch 40 snaps into the then lined up windows of sleeve and bolt (FIG. 6). The catch 45 is then pivoted by means of a ramp surface or similar, so that the transport container with tensed rammer can easily be moved further upwards.

The transport container 17 can have different constructions. One embodiment is shown in FIGS. 8 to 11. The transport container is essentially designed as cylindrical container, consisting of a rigid half-blown 46 and two quarter-bowls 48 attached to it via hinges 47, which complement each other to a cylindrical container. Springs 49 extend over the hinge joints 47, whereby the springs are supported on the quarter-bowls 48, on the one hand, and, on the other hand, on the half-bowl 46. These springs 49 hold the quarter-bowls in the opened positions shown in FIGS. 8 and 9. In these opened positions the quarter-bowls 48 reach with additions 50 into the area of the half-bowl 46, which has a window 51 for this purpose. In this manner, the insertion of the cartridge is possible as follows: the transport container is tilted slightly backwards in its lowest starting position. The cartridge, held, e.g., in the area of its tip, is set into the open transport container and tilted backwards (in FIG. 8 towards the right). This causes the cartridge 8 to push the sections 50 backwards, so that the force of the springs 47 is overcome and the quarter-bowls 48 fold into the closed position. In this closed position (FIGS. 10 and 11) the quarter-bowls are locked so that they cannot open at the wrong time during the motion of the transport container 17 into the loading positions. To make possible an automatic opening of the transport container 17, it is possible to arrange a catch in the lower area of the guide track, which opens the seal to that the quarter-bowls open under the influence of the springs 49.

We claim:

1. Device for loading an armored weapon with large caliber cartridges, which are kept ready on a floor of a loading area of a tank, wherein (a) a conveyor device (10) leading from the bottom of the loading area into a turret at the rear of a breech of the weapon (4), consisting of a transport container (17) for holding the cartridge (8) and a continuous belt (11), driven by a motor, (b) a guide device, consisting of a set of guide rollers (19, 20), arranged on each end of the transport container (18) and two guide tracks (22, 23), one each assigned to each set of rollers, which bring the transport container (17) with the inserted cartridge (8) form an approximately vertical position at the foot of the conveyor device (10) to a horizontal position, aligned with the weapon (4) at the rear of the breech of the weapon (4), (c) a rammer (33) which, with open breech, speeds the cartridge (8) into the chamber (5) of the weapon from the transport container, wherein the guide track (22) for the roller set (19) at the rear end of the transport container (17) is rigidly arranged and the guide track (23) for the roller set (21) at the front end of the transport container (17) is mounted at the foot (24) of the conveyor device (10) in such a manner that, during the loading process, it can be pivoted with its upper end from a position (23') removed from the rear of the breech of the weapon (4) into a position at the rear of the breech and during the return of the empty transport container (17) again into the removed position (23').

2. Device according to claim 1, wherein the conveyor device (10) has a continuous chain (11) as continuous drive, which is drive by an electric motor at the foot of the conveyor device (10) and to which the transport container (17) is hooked by its rear end through a pivot bearing (18).

3. Device according to claim 1, wherein the rigidly arranged guide track (22) and the pivotally mounted guide track (23) are slightly tilted backwards in their removed position (23') while the latter (23) are arranged approximately vertical in the position near the breech.

4. Device according to claims 1 or 3, wherein the pivotable guide track (23) runs at its upper end in a fixed guide (25) extending beyond the pivoting angle.

5. Device according to claim 1, wherein the pivotable guide track (23) is assigned to a pivoting drive which provides it with a motion synchronized to the motion of the transport container (17).

6. Device according to claim 1, wherein the pivoting drive consists of a continuous chain (26) and crank (29), driven by a chain wheel (28) of the continuous drive.

7. Device according to claim 1, wherein the continuous chains (11, 26) of the conveyor device (10) and the pivotable guide track (23) are driven by the same electric motor (12), installed at the foot of the conveyor device (10).

8. Device according to claim 1, wherein the crank (29) for the chain wheel (28) moving the pivotable guide track (23) is mounted on the rigid guide track (22).

9. Device according to claim 1, wherein the transport container (17) is designed essentially cylindrical and consists of a rigid half-bowl (46) and quarter-bowls (48) hinged to it, which can be flipped open for the insertion of the cartridge (8) and can be flipped to a closed position and locked after the insertion.

10. Device according to claim 9, wherein between the rigid half-bowl (46) and each quarter-bowl (48) there is at least one spring (49) reaching over the joining hinge (47), which hold the quarter-bowls (48) in the flipped open position and against the effect of which the quarter-bowls (48) can be flipped in a lockable closed position with the insertion of the cartridge (8).

11. Device according to one of the claims 9 or 10, wherein the quarter-bowls (48) have, at least one segment (50) with the same arc radius each reaching into the are of the half-bowl (46), against which the cartridge (8), to be set on the bottom of the transport container (17) and tilted against the half-bowl (46) hits and flips the quarter-bowls (48) into the locked position during the tilting motion.

12. Device according to claim 9, wherein the locking of the quarter-bowls (48) can be released by a stop arranged in the area of the foot of the conveyor device (10).

13. Device according to claim 1, wherein the rammer (33) is arranged on the transport container (17) and has, acting on the bottom of the cartridge (8), a bolt (37) which is under the influence of a prestressed spring (35), which can be triggered on reaching the horizontal end position of the transport container.

14. Device according to claim 13, wherein the rammer (33) has a sleeve (34) mounted parallel to the axis on the outside of the rigid half-bowl (46) of the transport container (17) and guiding the bolt (37), in which the spring (35) is housed and that a catch (40) is tilted against the sleeve (34), holding the bolt (37) in a prestressed position.

15. Device according to claim 13 or 14, wherein the catch (40) works jointly with a fixed trigger (41), against which the catch (40) hits on reaching the horizontal end position of the transport container (17) and thus releases the bolt (37).

16. Device according to claim 13, wherein the spring (35) of the rammer (33) is tensed during the upwards motion of the transport container by a catch (45) reaching into the its path (31, 32) and retaining the bolt (37) for a certain length of way, until the catch (40) holding the bolt (37), hooks in.

17. Device according to claim 1, wherein on the top side of the breech a guide bowl (42) is flipably mounted which, in the horizontal end position of the transport container (17) adjoins its lower apex and guides the cartridge (8) during its acceleration by the rammer (33) via the breech into the weapon chamber (5).

18. Device according to claim 1, wherein the drive motor (12) for the conveyor device (10) and the breech of the weapon (4) are blocked by end switches and/or sensors in such a manner that (a) an upward motion of the transport container (17) is only possible with open breech and empty weapon chamber, (b) the breech can only be locked and the weapon (4) fired when the transport container (17) is in its lower end position and the pivotable guide track (23) in its position (23') removed from the breech.

* * * * *